US009284784B2

(12) United States Patent
Zaki et al.

(10) Patent No.: US 9,284,784 B2
(45) Date of Patent: Mar. 15, 2016

(54) DOWNHOLE ASSEMBLY, TOOL AND METHOD

(71) Applicant: TERCEL IP LIMITED, Tortola (VG)

(72) Inventors: Magdy M. Zaki, Cairo (EG); Omar Ahmed, Houston, TX (US); Karim A. Aguib, Cairo (EG); Ahmed Galal Abdel-Kader, Cairo (EG)

(73) Assignee: Tercel IP Ltd., Road Town, Tortola (VG)

( * ) Notice: Subject to any disclaimer, the term of this patent is extended or adjusted under 35 U.S.C. 154(b) by 0 days.

(21) Appl. No.: 14/222,363

(22) Filed: Mar. 21, 2014

(65) Prior Publication Data

US 2014/0202770 A1 Jul. 24, 2014

Related U.S. Application Data

(63) Continuation of application No. PCT/IB2013/000890, filed on May 8, 2013.

(30) Foreign Application Priority Data

May 11, 2012 (GB) ..... 1208286.3

(51) Int. Cl.
*E21B 10/30* (2006.01)
*E21B 10/26* (2006.01)
*E21B 10/567* (2006.01)

(52) U.S. Cl.
CPC ..... *E21B 10/30* (2013.01); *E21B 10/26* (2013.01); *E21B 10/5673* (2013.01)

(58) Field of Classification Search
CPC ..... E21B 10/26; E21B 10/567; E21B 10/46; E21B 10/55; E21B 10/44; E21B 10/30; E21B 7/00; E21B 10/43
USPC ..... 175/394, 401, 323, 406, 434, 325.1, 57
See application file for complete search history.

(56) References Cited

U.S. PATENT DOCUMENTS 3,306,381 A 2/1967 Garrett et al.
3,938,853 A * 2/1976 Jurgens et al. ..... 175/325.2
(Continued)

FOREIGN PATENT DOCUMENTS

EP 1811124 A1 7/2007
EP 1811125 A1 7/2007
(Continued)

OTHER PUBLICATIONS

British Search Report of British Patent Application No. 1208286.3 dated Aug. 13, 2012.
British Supplemental Search Report of British Patent Application No. 1208286.3 dated Sep. 18, 2012.
(Continued)

*Primary Examiner* — Blake Michener
*Assistant Examiner* — Wei Wang
(74) *Attorney, Agent, or Firm* — Lloyd L. Davis; Andrews Kurth LLP

(57) ABSTRACT

A reaming tool includes a body having a longitudinal axis and an upper end opposite a lower end and a blade located on said body, the blade including a reaming surface having one or more reaming inserts disposed on at least a portion thereof and a cutting surface having one or more cutters disposed on at least a portion thereof. One or more of said cutters are configured (a) so that an extended longitudinal axis of said cutter is positioned at an angle θ between 5 degrees and 85 degrees with respect to a plane perpendicular to the longitudinal axis of said body, or (b) on said cutting surface at a radial distance from said longitudinal axis less than said radial distances between said reaming inserts and said longitudinal axis.

17 Claims, 9 Drawing Sheets

(56) References Cited

U.S. PATENT DOCUMENTS

| | | | | |
|---|---|---|---|---|
| 4,275,935 | A * | 6/1981 | Thompson et al. | 175/325.7 |
| 4,385,669 | A * | 5/1983 | Knutsen | 175/323 |
| 6,880,650 | B2 * | 4/2005 | Hoffmaster et al. | 175/263 |
| 7,477,162 | B2 * | 1/2009 | Clark | 340/854.6 |
| 7,631,706 | B2 * | 12/2009 | Cooper et al. | 175/61 |
| 8,353,370 | B2 * | 1/2013 | Bellin et al. | 175/431 |
| 8,607,900 | B1 | 12/2013 | Smith | |
| 2009/0188725 | A1 | 7/2009 | Rai et al. | |

FOREIGN PATENT DOCUMENTS

| | | | |
|---|---|---|---|
| GB | 2274129 | A | 7/1994 |
| GB | 2328964 | A | 3/1999 |
| WO | 0058595 | A1 | 10/2000 |
| WO | 2004029402 | A1 | 4/2004 |
| WO | 2006121699 | A2 | 11/2006 |
| WO | 2009123918 | A2 | 10/2009 |
| WO | 2013167954 | A3 | 11/2013 |

OTHER PUBLICATIONS

Scott, G. and L.M. Smith, AER, Inc. "Successful Application of Innovative Reaming and Completion Technology in Williston Basin Wells", Society of Petroleum Engineers Production and Operations Symposium, Oklahoma City, Oklahoma, USA, Mar. 23-26, 2013, SPE 16458, pp. 1-10.

"Plaintiff Tercel Oilfield Products USA L.L.C.'s First Amended Complaint and Application for Preliminary Injunctive Relief" No. 4:13-cv-03139; *Tercel Oilfield Products USA L.L.C.* v *Alaskan Energy Resources, Inc.*; in the U.S. District Court for the Southern District of Texas, Houston Division, on Dec. 24, 2013 [Document 24].

Defendants Alaskan Energy Resources, Inc.'s Answer and Affirmative Defenses No. 4:13-cv-03139; *Tercel Oilfield Products USA L.L.C.* v *Alaskan Energy Resources, Inc.*; in the U.S. District Court for the Southern District of Texas, Houston Division, on Mar. 5, 2014 [Document 46].

Declaration of David Morrissey dated Apr. 29, 2014.

International Preliminary Report on Patentability (PCT/IB2013/000890), dated Nov. 11, 2014.

* cited by examiner

DOWNHOLE ASSEMBLY, TOOL AND METHOD

CROSS-REFERENCE TO RELATED APPLICATIONS

This continuation application claims benefit under 35 U.S.C. §365(c) to co-pending PCT International Application No. PCT/IB2013/000890 filed May 8, 2013, and claims priority under 35 U.S.C. §119 to GB 1208286.3 filed May 11, 2012, both of which are incorporated herein by reference in their entirety.

FIELD

The present invention relates to the field of oil and gas exploration and development, and in particular well bore forming activities. More specifically, the present invention relates to a reaming insert, an assembly, a method and a tool for reaming a well bore and a method of manufacturing such a tool.

BACKGROUND

In the oil and gas industry, non-straight wells are formed using directional drilling techniques. The drilling process involves initially drilling a pilot borehole using a drill string with a drilling bottom hole assembly (BHA) having a drill bit at the leading end thereof. The pilot borehole must be subsequently reamed so as to accommodate casing, production pipe, etc., and to improve borehole gauge, shape and condition, using one or more reaming tools. The so formed well is then "completed", i.e. made ready for production by installing casing (if applicable), production pipes and associated tools and perforating and stimulating the bottomhole.

More specifically, firstly the drill bit is advanced downward until the drill bit has reached the target depth. The drillstring is then pulled out and a reaming BHA is attached at the leading end of the drillstring. This reaming BHA is then pushed downhole, reaming and conditioning the borehole prior to well completion and subsequently pulled out while at the same time reaming the borehole on the way out. As discussed above, this type of reaming requires a specific reaming run after the pilot hole has been created and prior to performing well completion, which is inconvenient and inefficient. The necessity to pull the drilling BHA out of borehole to replace it with a reaming BHA results in expensive non-production time.

Poor borehole quality is generally observed and can result from:

- deviation of the directional path of the well and the directional behavior of the steering device from the planned track creating tortuosities;
- poor drilling practices causing vibrations and whirl action at the drill bit;
- improper hole cleaning causing sedimentation;
- improper drilling fluid composition not suppressing some aspects of the formation transience and formation swelling after being drilled;
- BHA moving through different formations resulting in the drillstring straying from prescribed path;
- the drilling tools not performing as they should whereby the drill bit leaves behind an improper hole quality and steering device oscillating about specified target path; or
- drilling through interbedded formation resulting in presence of hard stringers.

Poor hole quality affects the drilling and completions processes causing the following problems:

- problems running in hole and pulling out of hole due to the obstacles that face the drillstring moving forward and backward;
- poor dynamic response of the BHA; and
- problems in running completions down and in its proper deployment.

Accordingly, borehole conditioning is a factor in conducting efficient drilling and completions processes, especially in complex operations that range from:

- multi-lateral wells;
- deep horizontal wells;
- extended reach drilling;
- high pressure high temperature wells; and
- high angled well profiles: J-profile, S-profile.

Poor borehole conditioning results in non-productive time (NPT) in all steps of the drilling and completions processes. Thus it is a general practice to conduct a dedicated reaming run with controlled parameters after the drilling run, to try to condition the borehole to desirable quality.

Various elements have been included in drilling BHAs in order to improve borehole quality during drilling. Such elements include fixed blade reamers or roller reamers, which indeed can provide a degree of reaming during drilling.

Document EP 1 811 125 discloses a vibration damping reamer for use in association with a drill stem and a drill bit in drilling a hole in a rock formation. The vibration damping reamer comprises a body having a through going bore passage of drilling fluids there through. The body has a cylindrical upper part adapted for connection to a drill string, and a cylindrical lowermost reamer part of diameter wider than the upper part. The reamer part comprises a plurality of wear surfaces located on an outer surface and arranged along at least an upper band of wear surfaces and a lower band of wear surfaces axially spaced along the reamer part and separated by an intervening band. By this arrangement of axially spaced reaming bands along the length of the body, the reamer is brought to bear against the drilled hole-wall at axially spaced positions. The surfaces of the reamer bear against the hole-wall thereby ensuring any vibrations induced by the tool are damped. The adoption of two or more bearing points, represented by the wear surfaces provides stability in the position of the reamer and thereby of the drill assembly. Spiral flutes are cut on the outer surface and evenly spaced around the circumference of the body. Spiral flutes serves to allow for passage of drilling fluid and entrained rock material collected from a hole during a drilling operation. In order to create the desired vibration damping effect, the wear surfaces are studded with an array of hardwearing carbide studs. However this tool only has the effect of minimizing the lateral movement of the bit and hence extending the life of the bit and increasing the drilling rate of penetration, yet if the hole quality is poor due to any of the multiple reasons stated earlier this tool won't eliminate the need for utilizing a dedicated reaming run.

During drilling as well as during POOH (Pulling out of the hole), it is desirable to prevent stuck pipe occurrences and to be able to handle the repercussions of such situations such as:

- Mobile formations
- Fractured and faulted formations
- Reactive formations
- Over-Pressured formations
- Hole cleaning problems
- Unconsolidated formations
- Key seats
- Ledges and micro doglegs
- Swelling shale and salt formations Heavy back reaming Tight spots Document WO2004/029402 discloses a combined reamer and stabilizer tool. This tool comprises a body on which is provided:

- A stabilizer comprising a portion of larger diameter than the body and fluted by a series of helically shaped flutes forming a plurality of ribs destined to be in contact with the wall of the bore being drilled and;
- A reamer portion below said stabilizer, comprising cutting means.

Optionally, three rows of carbide inserts are provided up to the stabilizer for assisting the withdrawal of the drill string.

However the reaming structure uses conventional full dome shaped carbides or other cutting means with different materials. The disadvantage being that the gauge held by this full dome shaped carbide will change as the carbide starts to develop a wear area as it contacts the formation. This inherent disadvantage renders the tool as not holding the required gauge for long and this affects the directional behavior of the drilling operation.

In view of the above, it is an object of the present invention to obviate and mitigate drawbacks of the prior art and to provide a downhole assembly, a method and a tool suitable for hole drilling and reaming which are more convenient and efficient compared to existing reaming methods and tools and a method of manufacturing such a tool.

More particularly, it is an object of the present invention to avoid the requirement for a specific reaming run to condition the borehole after drilling a borehole and prior to a well completion run.

It is another object of the present invention to eliminate any borehole undergauge which may occur due to excessive formation swelling.

It is desirable to improve borehole shape, straightness and quality by removing ledges and micro-doglegs. It is also required to have a reaming tool that holds the gauge for the longest possible duration for better direction control. High quality of the hole is desirable to solve completions deployment problems due to poor hole quality and to increase the BHA dynamic performance.

It is desirable to prevent stuck pipe occurrences during drilling as well as during POOH (Pulling out of the hole).

SUMMARY

In a first aspect, the present invention is related to a reaming insert for a reaming tool. Preferably, the reaming tool is a tool comprising a reaming gauge portion, such as reamers or drill bit (also called a drilling tool) comprising a reaming gauge portion. The reaming insert according to the present invention has the shape of a truncated dome. Preferably, such an insert comprises a generally dome shaped portion protruding from a blade of a reaming tool, said dome shaped portion having a flat top facing away from the surface of the blade.

In a second aspect, the present invention relates to a reaming tool comprising a body having reaming gauge portion.

Preferably, the reaming gauge portion of the reaming tool comprises reaming inserts having the shape of a truncated dome.

Preferably, the reaming tool comprises one or more blades forming the reaming gauge portion, the one or more blade-shaving a reaming surface which is an outerface of the blade facing substantially radially outwardly from the body of the reaming tool and provided with an array of reaming inserts. Advantageously, the array of reaming inserts of one or more reaming surfaces encompasses the body fully around 360° if the reaming tool is viewed along its longitudinal axis.

Preferably, the reaming inserts are equally spaced on said reaming surface providing equal load application on the reaming surface.

Preferably, the reaming tool comprises a number M of blades forming the said gauge portion, and the disposition of the said blades on the said body has an M-fold rotational symmetry respect to the longitudinal axis of said body.

Preferably, the one or more blades of the reaming tool is/are arranged to form a helix on the body, said helix having a predetermined helix angle $\alpha$ between a tangent to the helix and a generator of a cylinder upon which the helix lies.

Preferably, the reaming inserts are arranged on the reaming surface in a number N of substantially parallel rows extending substantially parallel to a longitudinal axis of said reaming surface, the rows being laterally spaced from each other by a predetermined distance R, and wherein the shortest distance along said longitudinal axis of the said body, between any two nearest inserts in two adjacent rows and between any two nearest inserts in two opposing outer rows is one and the same and has a predetermined value Y.

Preferably, two adjacent inserts in the same row are spaced by a predetermined distance L and the shortest distance in the direction of the longitudinal axis of said body between two adjacent inserts in the same row can be determined as $X=L \cos \alpha$, wherein the distance Y is X/N and $\alpha$ is the angle between the longitudinal axis of said body, and the longitudinal axis of said reaming surface.

Preferably, each row nearest to a longitudinal edge of the reaming surface is offset from the longitudinal edge by a predetermined distance E, wherein the ratio R/E has a predetermined value.

Preferably, the reaming inserts have an outermost portion protruding from the said reaming surface, and the said outermost portions are located at a radial distance from the said longitudinal axis of said body, so as to allow for balanced drilling and reduced vibrations.

Preferably, said reaming surface is the outermost surface of the said blade, and said blade further comprises a cutting surface disposed obliquely with respect to the said reaming surface, said cutting surface being provided with cutters.

More preferably, the said cutters are arranged along the said cutting surface between a first radial distance and a second radial distance from the said longitudinal axis of said body, so as to allow for balanced drilling and reduced vibrations.

More preferably, the said cutters are arranged along the said cutting surface at a radial distance from the said longitudinal axis of said body inferior to the said radial distance between said reaming inserts and said longitudinal axis of said body.

Preferably, each cutter comprises a longitudinal axis and the cutters are oriented so that the longitudinal axis of each cutter extends in a pre-determined direction and is positioned at a predetermined angle to a plane perpendicular to the longitudinal axis of said body, the predetermined angle being adjustable to a required value.

Preferably, the body of the reaming tool comprises an upper end opposite a bottom end, said first end comprising a connection means for an upper drill string and said bottom end comprising a connection means for a lower drill string or a drilling collar or a drill bit.

According to a third aspect, the present invention relates to a downhole assembly comprising:

- a bottom hole assembly (BHA) for drilling a borehole the BHA comprising:

a housing having a longitudinal axis, a front end and a tail end, a drilling tool mounted at the front end;

and;

a reaming tool as described hereinabove according to the second aspect of the invention.

Preferably, the drilling tool comprises a longitudinal axis and a gauge, the gauge being a maximum cross sectional dimension in a plane normal to the longitudinal axis of said drilling tool wherein the diameter of the reaming gauge of the reaming tool according to the second aspect of the invention substantially corresponds to the diameter of the gauge of the drilling tool.

Preferably, the reaming tool of the downhole assembly comprises an upper end opposite a bottom end, said first end comprising a connection means for an upper drill string and said bottom end comprising a connection means for a lower drill string or for a drilling collar or a drilling tool.

According to a fourth aspect, the present invention relates to a method of reaming a borehole comprising the steps of:

providing a downhole assembly according to the third aspect of the present invention;

attaching the downhole assembly to a forward end of a drillstring;

drilling a pilot borehole until the reaming assembly reaches a target depth beneath surface; and withdrawing the drillstring from the borehole while rotating the reaming tool of the downhole assembly thereby reaming the borehole and eliminating borehole irregularities sufficiently to render the borehole ready for performing completion processes and preventing the BHA of the assembly from sticking while being withdrawn from the borehole.

All essential, preferred or optional features of the any one aspect of the invention can be provided in conjunction with the features of any other aspect of the invention as appropriate and vice versa.

As well as conditioning the borehole and preventing the BHA from sticking on the way out, the use of the downhole assembly according to the method of the present invention eliminates the requirement for a specific forward reaming run after drilling the pilot borehole and before performing completion processes.

BRIEF DESCRIPTION OF THE DRAWINGS

The present invention will now be described by way of example only, with reference to the accompanying drawings in which.

DETAILED DESCRIPTION

Figure 6:
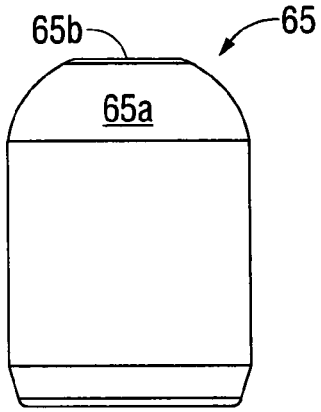
FIG. 6 is a schematic elevation of a truncated dome insert provided on an outer face of a blade of a reaming tool in accordance with the invention.
Figure 8:
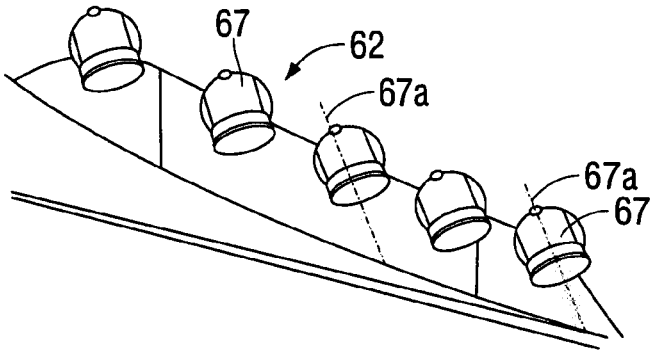
FIG. 8 is a schematic perspective view of a tapered portion of a blade of the reaming tool in accordance with the invention having a plurality of cutters arranged thereon.

According to a first aspect of the invention, an embodiment of a reaming insert 65 is represented at FIG. 6. The reaming insert 65 comprises a portion 65*a* having a shape of a truncated dome. Said portion 65*a* can be the whole reaming insert or a part of the reaming insert. The reaming insert 65 comprises a generally truncated dome shaped portion 65*a* having a flat top 65*b*. It has been found that such an insert has a more exposed contact surface area and hence develops wear at a slower rate than inserts with a smaller exposed contact area as with conventional full dome shaped inserts used in a reaming tool. Since the reaming insert of the present invention is less subject to wear, its shape varies less during the use of the reaming tool than the shape of a conventional dome shaped insert, which allows keeping the gauge of the reaming tool substantially constant for a longer time respect to a conventional reaming tool with dome shaped inserts.

The reaming insert of the present invention can be a tungsten carbide insert (TCI) or a polycrystalline diamond compact (PDC) insert. Advantageously, the truncated dome shaped reaming insert is a tungsten carbide insert.

Figure 5A:
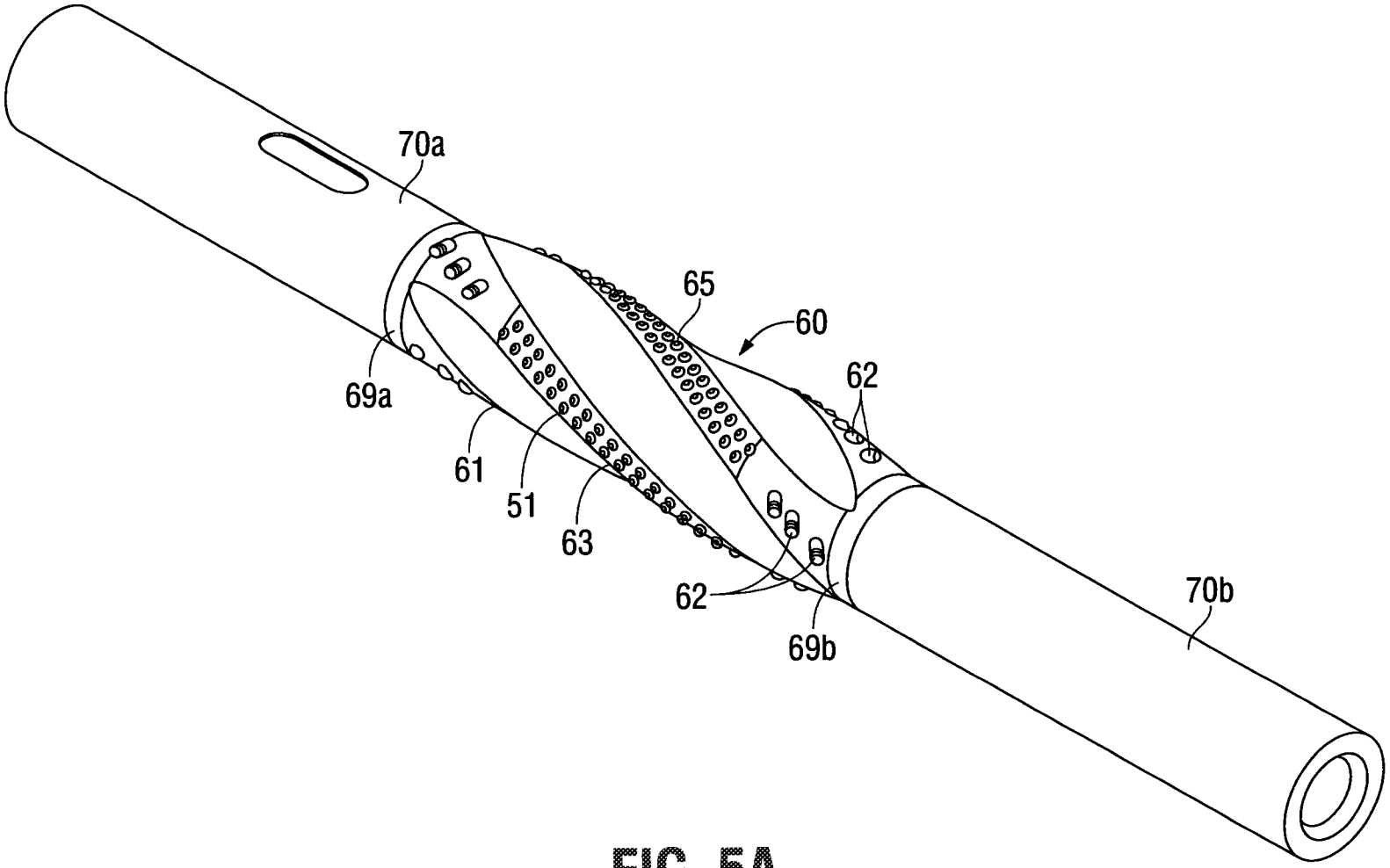
FIGS. 5A and 5B, respectively, are perspective and side views of a reamer tool used with the assembly of the present invention.
Figure 5B:
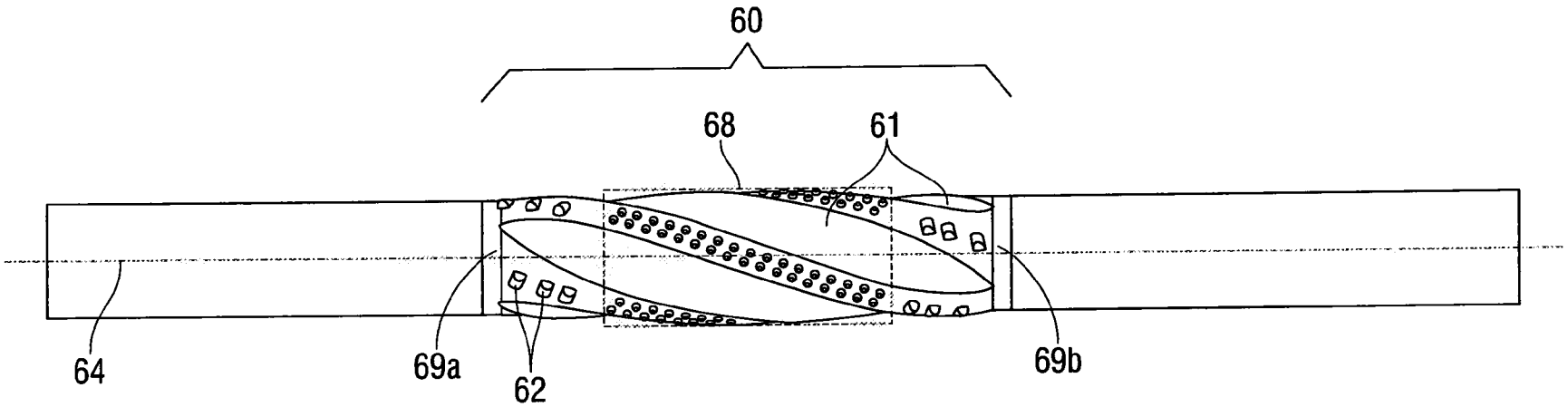

According to a second aspect of the invention, FIGS. 5A, 5B, shows an example of a first embodiment of a reaming tool 60 according to the present invention. The reaming tool comprises a body 61 having a longitudinal axis 64 and a reaming gauge portion 68 extending along and around the body 61 and provided by inserts 65. The gauge of the reaming tool is a maximum cross sectional dimension in a plane normal to the longitudinal axis 64 of said reaming tool 60 or said body 61.

In a first embodiment of the invention, the said reaming gauge portion 68 of the reaming tool 60 comprises reaming inserts 65 having the shape of a truncated dome or comprising a portion 65*a* having a truncated dome such as an embodiment of the insert represented on FIG. 6.

In a preferred embodiment, the body 61 of the reaming tool 60 comprises an upper end 69*a* opposite a bottom end 69*b*, said first end 69*a* comprising a connection means (not represented in the figures for reason of clarity) for an upper drill string 70*a* and said bottom end 69*b* comprising a connection means (not shown) for a lower drill string or for a collar 70*b* connected to a drill bit 15 or for a drill bit 15 directly.

The reaming tool 60 comprises at least one blade 63, preferably at least two blades 63, more preferably at least two blades 63 arranged for having a balanced reaming tool 60. The at least one blade 63 forms the reaming gauge portion 50 of the reaming tool 60, and has a reaming surface 51 being an outer face of the blade 63 facing substantially radially outwardly from the body 61 of the reaming tool 60. The reaming surface 51 is provided with an array of reaming inserts 65. Preferably, the reaming surface 51 extends totally along of the outer surface of the blade or along at least 50% of the outer surface of the blade.

Figure 10:
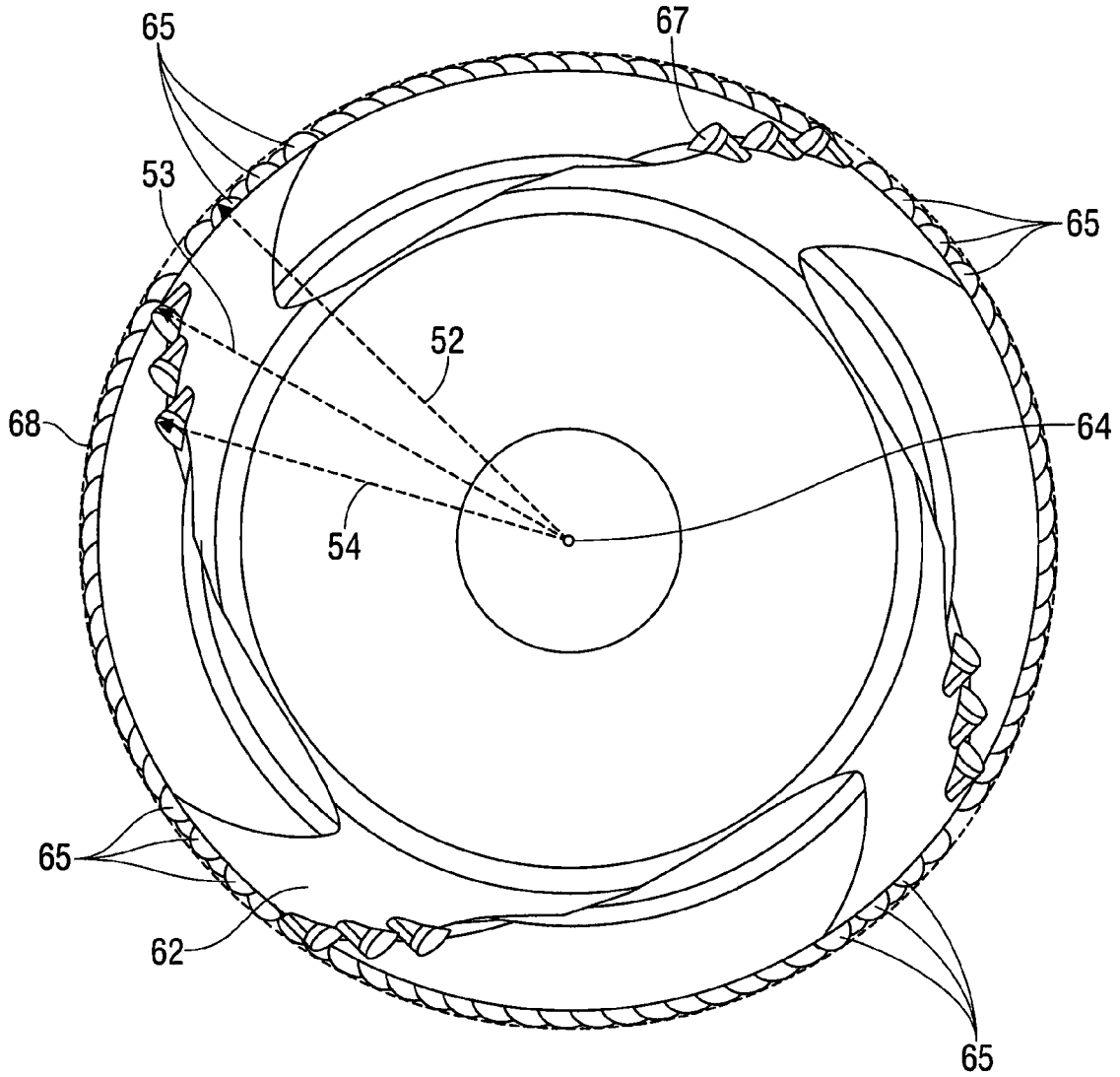
FIG. 10 is a view of the reaming tool according to an embodiment of the present invention along its longitudinal axis.

Preferably, the one or more blades 63 are arranged on the body 61 so that the blades 63 encompass the body 61 fully around 360°, i.e. without gaps, if the reaming tool 60 is viewed at along its longitudinal axis 64 as shown in FIG. 10. More preferably, the said array of reaming inserts 65 of one or more reaming surfaces 51 encompasses the body 61 fully around 360° if the reaming tool 60 is viewed along its longitudinal axis 64 as shown in FIG. 10.

In a preferred embodiment, the reaming inserts 65 are equally spaced on said blades 63 in the longitudinal direction and in the circumferential direction relative to the longitudinal axis 64 of the body 61, to provide equal load application in those directions. In a preferred embodiment, the reaming inserts 65 are provided on the blades 65 on a straight length of the blades.

In a preferred embodiment, the body comprises a number M of blades 63 forming the said reaming gauge portion 50. The M blades 63 are disposed on the said body 61 according to an M-fold rotational symmetry respect to the longitudinal axis 64 of the body 61. In a preferred embodiment of the invention, the tool comprises at least two blades 63 for providing balanced cutting.

The arrangement of the blades 63 on the body 61 may take various kinds of shapes. In a preferred embodiment of the invention, the blades are helically arranged on the body, each blade helix axis being coaxial with the body and having a predetermined helix angle $\alpha$ between a tangent to the helix and a generator of a cylinder including the body upon which the helix lies (the generator of the cylinder being a line on the outer surface of the cylinder parallel to the longitudinal axis wherein rotation of the generator around the longitudinal axis while the generator remains parallel to itself results in the formation of the outer surface of the cylinder).

Figure 7:
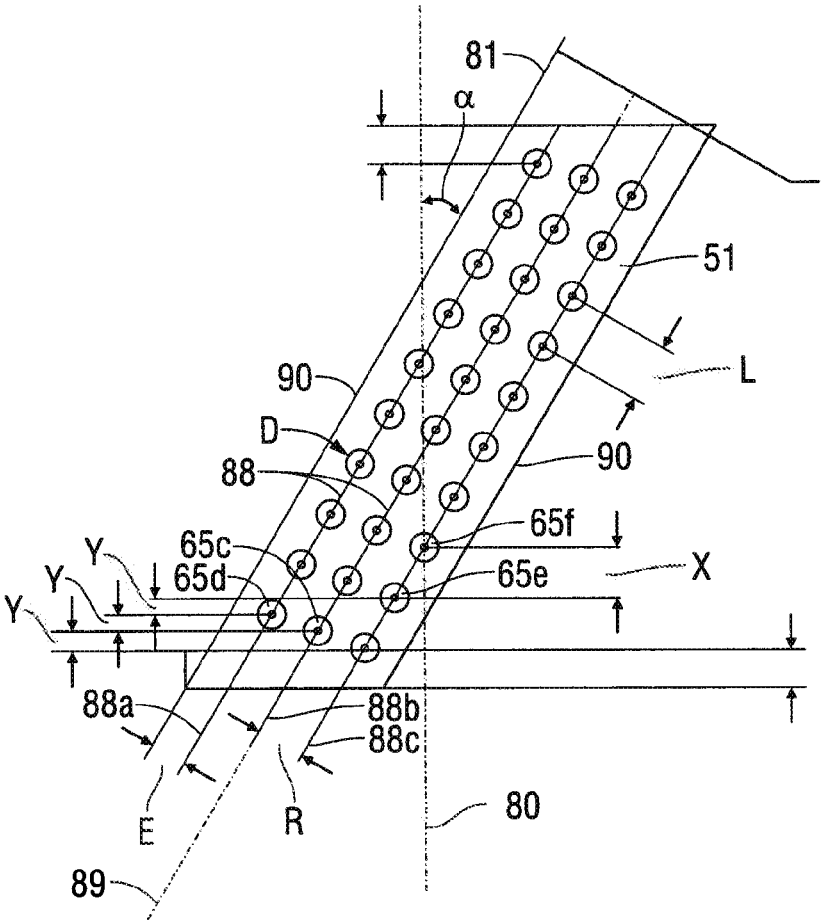
FIG. 7 is a plan view of an outer face of a blade of a reaming tool in accordance with the invention, the outer face having an array of inserts arranged thereon and the outer face being shown unwound from a helix into a plane for illustrative purposes.

In a preferred embodiment of the invention, as shown in FIG. 7, the reaming inserts are arranged on the reaming surface in a number N of substantially parallel rows 88 (e.g., 88*a*, 88*b*, 88*c*) extending substantially parallel to a longitudinal axis 89 of said reaming surface 51 (i.e. an axis in the center of the outer face which winds around the body following the path of the blade), the rows being laterally spaced from each other by a predetermined distance R, and wherein the shortest distance along said longitudinal axis 64 of the said body 61 (or along a generator of a cylinder 80 including the body 61 upon which the helix lies if the blade is an helix) between any two nearest inserts (i.e. the closest to each other along the longitudinal axis or the generator) in two adjacent rows (e.g., 65*c*, 65*d*), and between any two nearest inserts in two opposing outer rows (i.e. a first insert in one outer row and a second insert in the opposite outer row nearest to the first insert along the generator) (e.g., 65*d*, 65*e*) is one and the same and has a predetermined value Y.

In a preferred embodiment of the invention, two adjacent inserts in the same row are spaced by a predetermined distance L. Preferably, each insert has a diameter D. In a preferred embodiment, the predetermined distance L is a multiple equal, inferior or superior to 1 of the diameter D. Preferably, the predetermined distance L is two times the diameter D. The shortest distance in the direction of the longitudinal axis of said body between two adjacent inserts in the same row (e.g., 65*e*, 65*f*) can be determined as $X=L\cos\alpha$, wherein the distance Y is X/N and $\alpha$ is the angle between the longitudinal axis of said body and the longitudinal axis of said reaming surface.

In a preferred embodiment of the invention, each row nearest to a longitudinal edge 90 of the reaming surface is offset from the longitudinal edge by a predetermined distance E (i.e. the shortest distance between the row and the longitudinal edge), wherein the ratio R/E has a predetermined value. In a preferred embodiment, the R/E ratio is comprised between 1.25 and 1.5.

Preferably, the or each blade 63 has a pair of longitudinally spaced opposing ends 69*a*, 69*b* and the shortest distance, that is, the distance along the generator of the cylinder or along the longitudinal axis 64 of the body 61, between an insert nearest to each end and the end of the or each blade is the same at each end.

Such an arrangement of the inserts provides for equal distribution of the inserts in the longitudinal direction and thus ensures even distribution of load in the circumferential direction when the reaming tool 60 is in use. Furthermore, this arrangement provides for equal distribution of the inserts in the circumferential direction and thus ensures even distribution of load in the longitudinal direction when the reaming tool 60 is in use. Accordingly, the inserts 65 wear uniformly.

In a preferred embodiment of the invention, reaming inserts 65 have an outermost portion 65*b* protruding from the said reaming surface 51 and the said outermost portions 65*b* are located at a radial distance 52 from the said longitudinal axis 64 of said body 61, so as to allow for balanced drilling and reduced vibrations, provided that the number of blades 63 is at least two and that the blades 63 are arranged for allowing balance of the tool 60, for example arranged symmetrically respect to the longitudinal axis 64 of body 61. For example all of the outermost portions 65*b* of the reaming insert 65 are located at the same radial distance 52 from the longitudinal axis 64 of the body 61. It can be possible also for the man skilled in the art to arrange some inserts 65 with their outermost portions 65*b* located at different radial distances from the longitudinal axis of the body, provided that an M-fold rotational symmetry of the tool 60 is conserved for avoiding unbalance of the tool 60.

The reaming surface 51 is advantageously the outermost surface of the blade 63.

In a preferred embodiment, the blades 63 comprise a cutting surface 62 disposed obliquely with respect to the said reaming surface 51, said cutting surface 62 being provided with cutters 67.

The cutting surface 62 increases borehole penetration capability of the reaming tool 60 with reduced torque. In particular, the cutting surface 62 enables the reaming tool 60 to "drill" behind a drilling tool 15 during forward advancement of the drillstring and/or ahead of the drilling tool during pulling out of hole. Preferably, the cutting surface 62 is provided by PDC cutters 67, to help open a borehole 100 in cases of severe swelling and/or borehole instability.

The cutting surface 62 can be tapered or bevelled. Preferably, the cutting surface 62 is tapered. The cutting surface 62 may be chamfered nearby the level of the position of the cutters.

Figure 9:
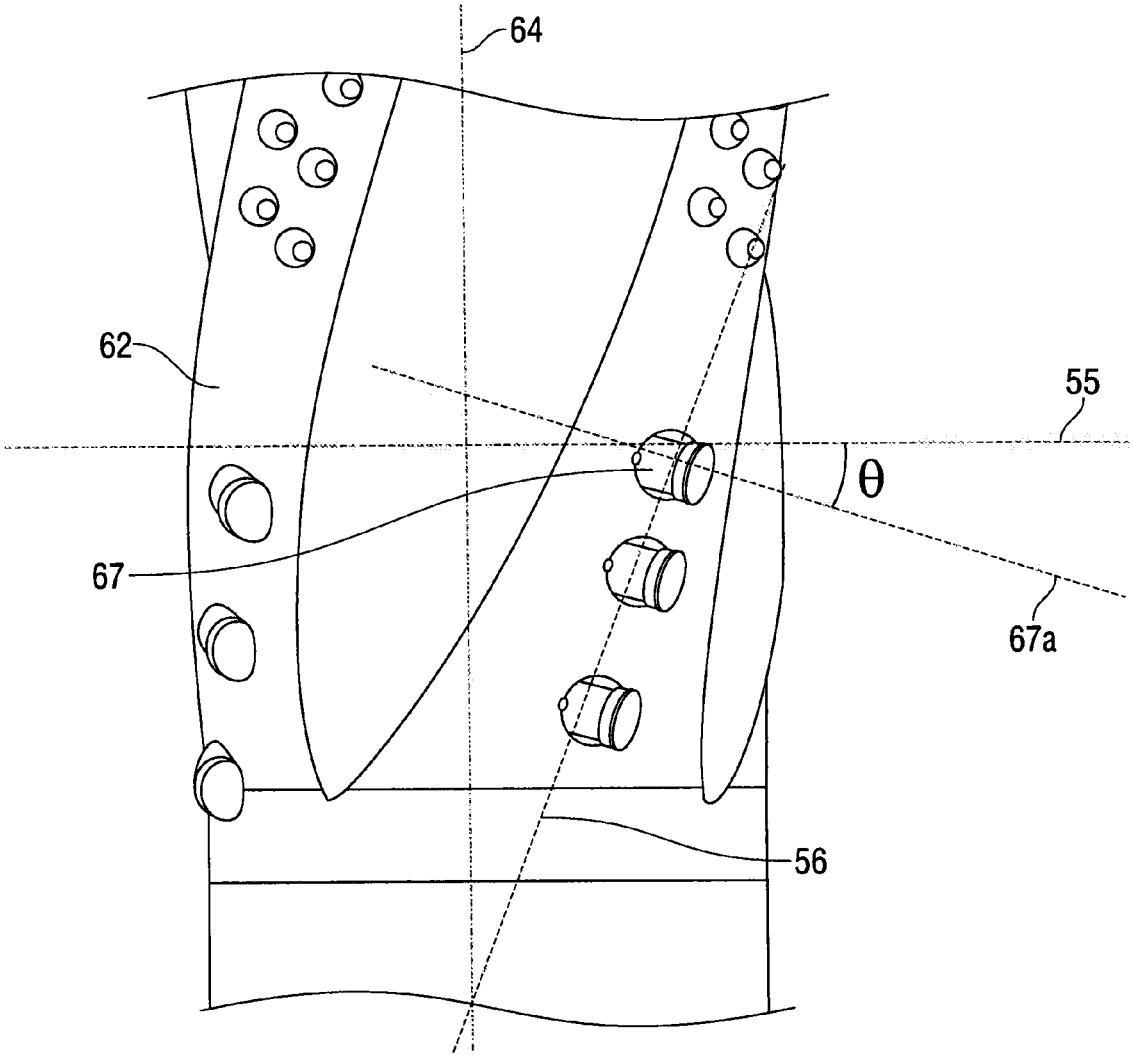
FIG. 9 is a schematic perspective view of the cutting surfaces of the reaming tool according to an embodiment of the present invention.

In a preferred embodiment of the invention, as shown in FIG. 9 and FIG. 10 the cutters 67 are arranged along the said cutting surface between a first radial distance 53 and a second radial distance 54 from the said longitudinal axis 64 of said body, so as to allow for balanced drilling and reduced vibrations. For example, each cutter 67 is equally spaced along an axis 56 of the cutting surface 62.

In a preferred embodiment of the invention, the cutters 67 are arranged along the said cutting surface 62 at a radial distance 53, 54 from the said longitudinal axis 64 of said body 61 inferior or equal to the said radial distance 52 between the outermost portion 65*b* of said reaming inserts 65 and said longitudinal axis 64 of said body. When the cutters are arranged as such, they act as a passive part of the reaming tool, whereby in use the cutters 67 remain out of contact with the walls of the borehole 100 unless the borehole develops an under gauge which the reaming gauge portion 68 of the tool cannot fully eliminate. Thus, the reaming tool 60 removes irregularities by the reaming surface 51 if the irregularities are relatively small (i.e. such that the cutting surface remains spaced from them) or by the cutting surface 62 if the irregularities are relatively large so that the cutting surface 62 comes into contact with them. Preferably the cutting surfaces 62 are provided on both ends 69*a*, 69*b* of the blades 63, allowing the removal of the relatively larger irregularities during the movement of the reaming tool in either direction in the borehole 100.

In a preferred embodiment of the invention, as shown in FIG. 9, the cutters 67 comprises a longitudinal axis 67*a* and are oriented so that the longitudinal axis of each cutter 67 extends in a pre-determined direction and is positioned at a predetermined angle θ to a plane 55 perpendicular to the longitudinal axis 64 of said body 61, the predetermined angle θ being adjustable to a required value. Preferably, this value is comprised between 5° and 85°, more preferably between 15° and 25°, and preferably of about 20°. The predetermined angle θ can be adjusted, e.g. during installation of the cutters 67, to a required value dictated by the drilling environment in which the tool 60 operates. Such an arrangement of the cutters 67 increases cutting efficiency of the tool 60 when the tool 60 advances along the borehole.

Preferably, the cutters are interference fit into the body of the tool. Alternatively, the cutters are brazed into the body of the tool.

In another embodiment of the present invention, the reaming tool 60 is a part of a drilling tool comprising a body having a gauge portion and provided by reaming inserts having a shape of a truncated dome. The man skilled in the art may provide such a drilling tool with one or more of the suitable features disclosed hereinabove.

In another embodiment of the present invention, the reaming tool 60 comprises:

- a body 61 having a longitudinal axis 64, a tail end 69*a* opposite a front end 69*b*, said tail end 69*a* comprising a connection means (not shown) for an upper drill string 70*a* and said front end 69*b* comprising a connection means (not shown) for a lower drill string or a drilling collar 70*b* or a drill bit 15;
- a blade 63 located on said body 61, said blade 63 comprising:
- a reaming surface 51 being the outermost surface of the said blade 63 and provided with reaming inserts 65, and;
- a cutting surface 62 disposed obliquely with respect to the said reaming surface 51, said cutting surface 62 being provided with cutters 67, and;
- the reaming inserts 65 have an outermost portion 65*b* protruding from the said reaming surface, the said outermost portions 65*b* being located at a radial distance 52 from the said longitudinal axis 64 of said body 61, so as to allow for balanced drilling and reduced vibrations and in that the said cutters 67 are arranged along the said cutting surface 62 at a radial distance 52, 53 from the said longitudinal 64 axis of said body 61 inferior to the said radial distance 52 between said outermost portions 65*b* of the reaming inserts 65 and said longitudinal axis 64 of said body 61.

In another embodiment of the present invention, the reaming tool comprises:

- a body 61 having a longitudinal axis 64, a tail end 69*a* opposite a front end 69*b*, said tail end 69*a* comprising a connection means for an upper drill string 70*a* and said front end 69*b* comprising a connection means for a lower drill string or a drilling collar 70*b* or a drill bit 15 and;
- a blade 63 located on said body 61, said blade 63 comprising:
- a reaming surface 51 being the outermost surface of the said blade 63 and provided with reaming inserts 65, and;
- a cutting surface 62 disposed obliquely with respect to the said reaming surface 51, said cutting surface 62 being provided with cutters 67 and;
- the said cutters 67 comprise a longitudinal axis 67*a* and are oriented so that the longitudinal axis 67*a* of each cutter 67 extends in a pre-determined direction and is positioned at a predetermined angle θ to a plane 55 perpendicular to the longitudinal axis 64 of the said body 61, the predetermined angle θ being adjustable to a required value.

In another embodiment, the reaming tool can be equipped with nozzles for better cleaning and cooling of cutting elements and for solving the possible problematic situations wherein the drilling fluid coming out of the drill bit is lost due to the excessive cavities in the formation and hence wherein the drilling fluid doesn't flow in the annulus and through the reaming tool hence having a situation with inadequate cleaning and cooling.

According to a third aspect of the invention, an embodiment of a downhole assembly is represented in FIGS. 2, 3, 4*a*, 4*b* and 4*c*.

The downhole assembly comprises a bottom hole assembly (BHA) 1 for drilling a borehole 100. Preferably, the BHA 1 comprises:

- a housing 10 having a longitudinal axis,
- a front end 11 and a tail end 12,
- a drill bit 15 mounted at the front end 11 and;
- a reaming tool 60 such as disclosed hereinabove.

Figure 1:
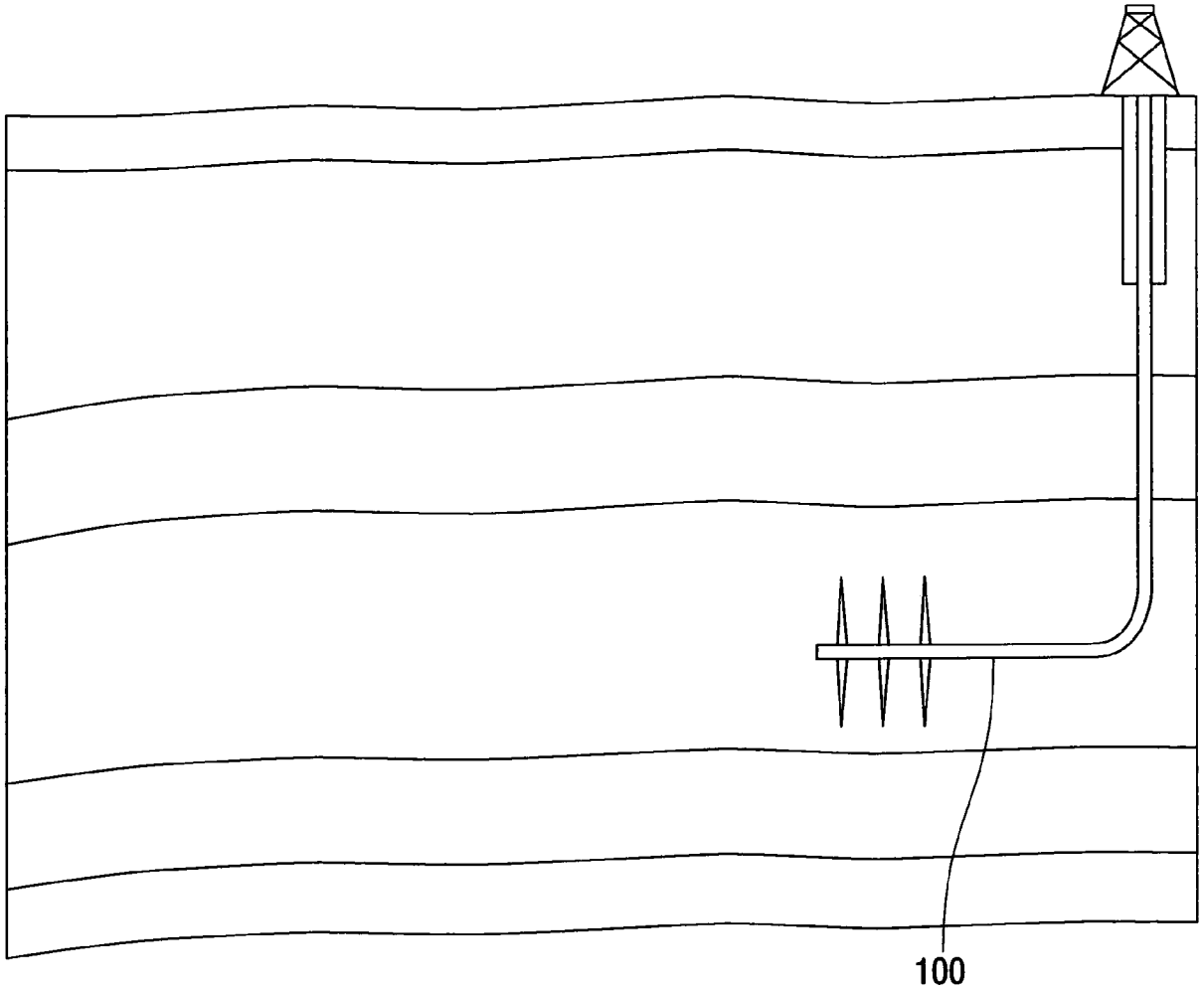
FIG. 1 is a schematic elevation of a directional borehole in a formation complete with surface casing showing a vertical lengthwise cross-section of the borehole of a long horizontal section.
Figure 2:
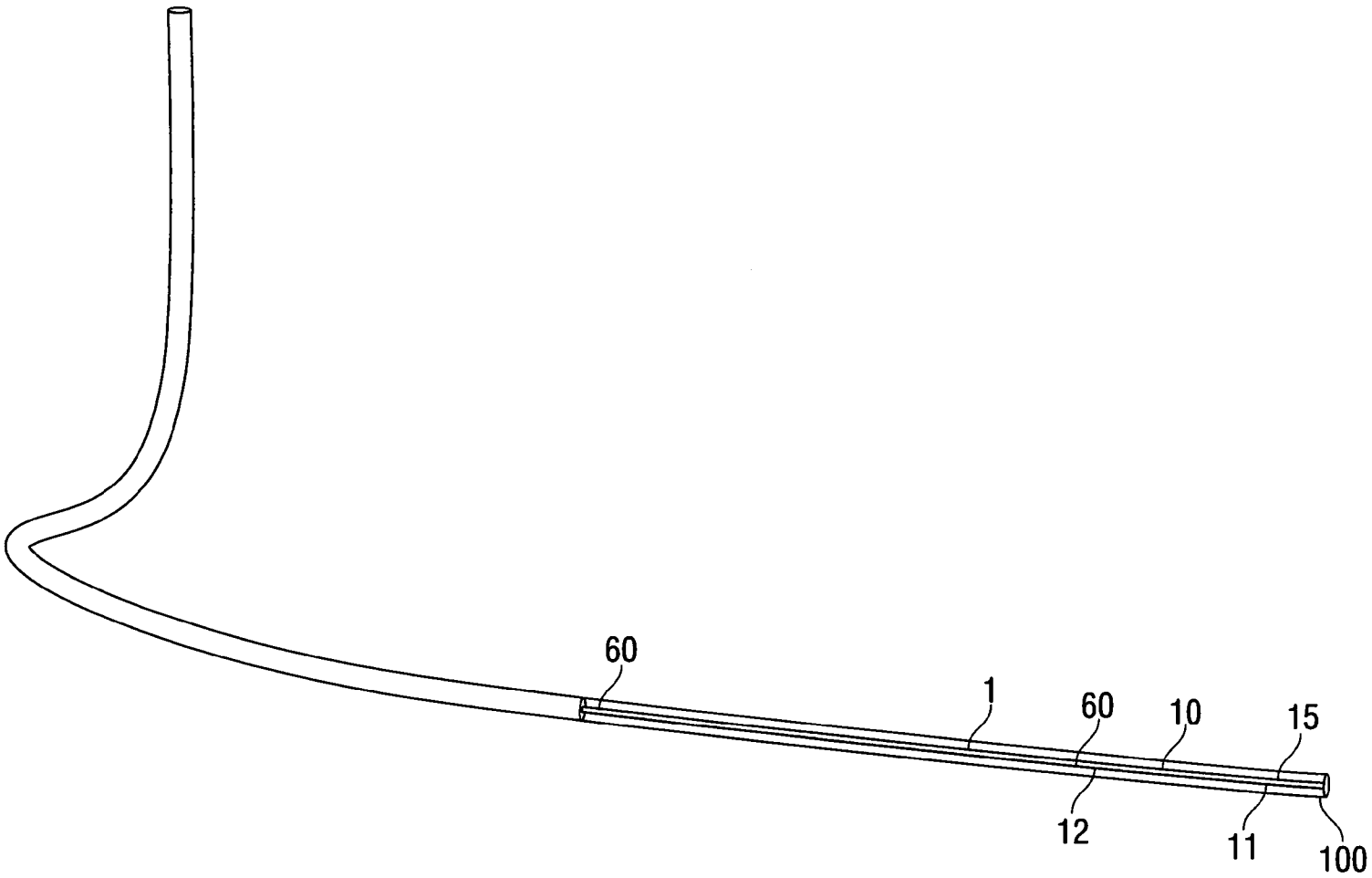
FIG. 2 is a schematic perspective view of a segment of a formation having a portion thereof cut away to show a cross-section of a deviated borehole in the formation with an assembly of the present invention shown located in the borehole.
Figure 3:
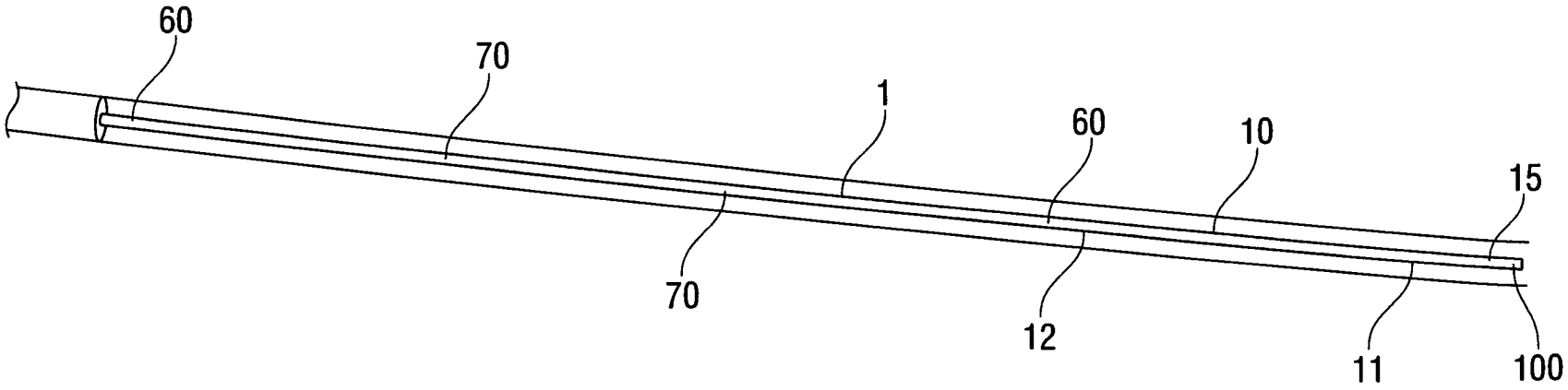
FIG. 3 is an enlarged view of the cross-sectioned portion of the formation of FIG. 2.
Figure 4A:
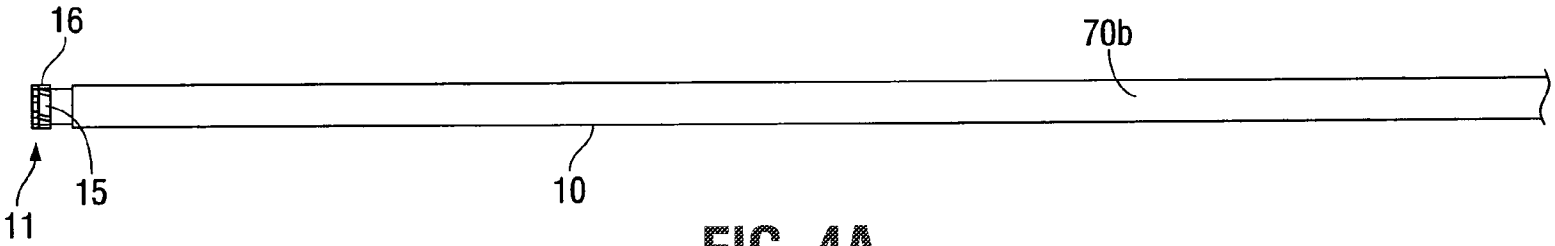
FIG. 4A is a schematic illustration of a front end segment of the assembly of FIGS. 2 and 3 having a drill bit attached to the front end.
Figure 4B:
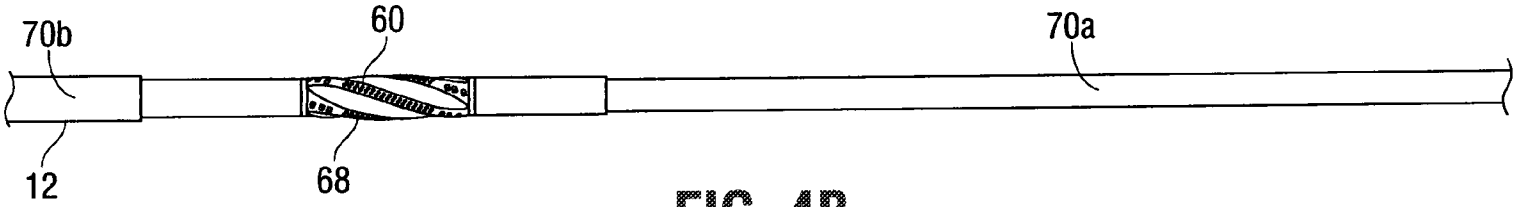
FIG. 4B is a schematic illustration of an intermediate segment of the assembly of FIGS. 2 and 3 including a first reaming tool.
Figure 4C:
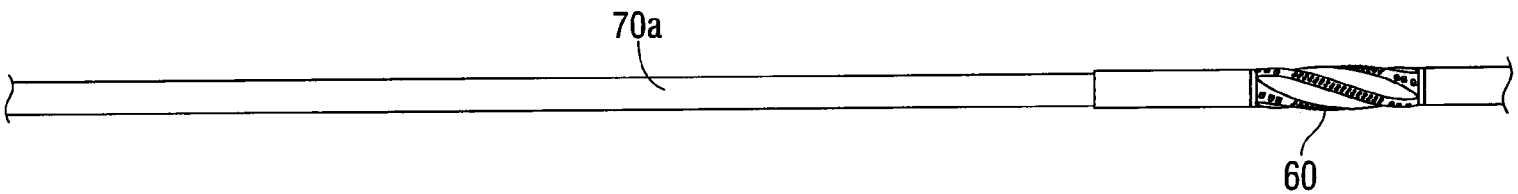
FIG. 4C is a schematic illustration of a tail end segment of the BHA of FIGS. 2 and 3 including a second reaming tool.

A downhole assembly of the present invention is most suitable for vertical or deviated blind hole drilling (one exemplary deviated borehole 100 is illustrated in FIG. 1), but the invention need not be limited to the use in forming these types of borehole only. In a preferred embodiment of the invention, the reaming tool 60 included in the BHA 1 comprises a tail end 69*a* opposite to a front end 69*b*, said first end 69*a* comprising a connection means (not shown) for connecting the reaming tool 60 with an upper drill string 70*a* and said front end 69*b* comprising a connection means (not shown) for connecting the reaming tool 60 with a lower drill string or a collar 70*b* or for a drill bit 15.

Preferably, the reaming tool 60 is sized and shaped with respect to the drilling tool 15 so as to ream the borehole 100 during backward movement of the BHA 1 in the borehole 100, the size and shape of the reaming tool 60 being sufficient to ream the borehole 100 sufficiently to render the borehole 100 ready for performing well completion.

Preferably, the reaming tool 60 is sized and shaped with respect to the drill bit 15 so as to ream the borehole 100 during forward movement of the BHA 1 in the borehole 100, the size and shape of the reaming tool 60 being sufficient to ream the borehole 100 sufficiently to eliminate borehole irregularities so as to allow a drillstring 70*a* to which the BHA 1 is coupled in use to advance along the borehole 100 being formed. Such an arrangement allows the reaming tool 60 to eliminate borehole irregularities to prevent the drillstring from sticking during forward movement of the BHA 1 as well as to ream the borehole 100 during backward movement of the BHA 1 so as to eliminate any borehole undergauge which may occur due to excessive formation swelling and so as to render the borehole ready for well completions procedures.

In use, the downhole assembly is coupled to a forward end of a drillstring.

For the purposes of the present description, unless otherwise specified, the terms "front" and "forward" in relation to the BHA and its components means facing or moving in a direction away from an entry opening of a borehole at surface, and "tail" and "backward" means facing towards or moving in a direction towards the entry opening of the borehole. The terms "axial", "longitudinal" or the like are used in relation to the longitudinal axis of the BHA housing (which corresponds to a longitudinal axis of the drillstring in use), unless otherwise specified.

In one embodiment, the tool is mounted at the tail end of the housing. In principle, the reaming tool can be positioned anywhere along the BHA and offset from the front end towards the tail end of the housing.

In use, the BHA 1 is attached to a forward end of a drillstring and the drill bit 15 is advanced through formation until the drill bit 15 has reached the target depth. The drillstring is then pulled out with the reaming tools 60 leading and the drill bit 15 tailing while the reaming tools 60 are being rotated by the top drive thereby enlarging and conditioning the borehole 100 prior to performing completion procedures and preventing sticking of the BHA 1 downhole. Because the reaming is accomplished in the backward direction, the BHA 1 automatically follows the path of the rest of the drill string being pulled out.

In a preferred embodiment of the downhole assembly, said drill bit 15 has a longitudinal axis (not shown) and a gauge 16, the gauge 16 of the drill bit being a maximum cross sectional dimension in a plane normal to the longitudinal axis of said drill bit 15, the diameter of the gauge 16 of the drill bit 15 being substantially the same than the diameter of the reaming gauge 68 of the reaming tool 60. This embodiment allows the reaming tool 60 to ream the borehole 100 during forward movement of the BHA 1 and to ream the borehole 100 during backward movement of the BHA. The gauge difference between the drill bit 15 and the reaming tool 60 can either exist or not.

In a preferred embodiment, the reaming tool 60 is coupled to and is rotatable by a driving device (not shown), which can be located at surface, such as for example, a top drive. The driving device is preferably used to rotate the reaming tool 60 while the BHA 1 is being pulled out of the borehole 100, but it can also be used to rotate the reaming tool 60 during forward movement of the drillstring. The drill bit 15 can be arranged to be rotatable by a driving device at surface or a downhole motor, the latter being typically housed within the BHA 1 housing 10.

In a preferred embodiment of the invention, the BHA 1 comprises more than one and, preferably, two or more of such reaming tools 60, mounted on the BHA 1 in an axially spaced relationship at the tail end 12 of the housing 10.

The assembly of the present invention eliminates the requirement for a specific reaming run to condition the borehole 100 after a pilot borehole 100 has been created and prior to well completion procedures. Accordingly, non-production time caused by the necessity to pull the BHA 1 out of borehole 100 to replace the drill bit 15 with a forward reamer at the front end 11 of the BHA 1, as has been the case heretofore, is reduced considerably. The assembly of the present invention eliminates any borehole undergauge which may occur due to excessive formation swelling and improves borehole shape, straightness and quality by removing ledges and micro-doglegs. As well as conditioning the well, the reamers 60 serve as the upper most gauge device in the BHA 1 during the movement of the BHA 1 in the borehole, either forward during drilling or backward (backreaming) while pulling out of borehole (POOH) and thereby prevents sticking of the BHA 1 by enlarging the borehole diameter so that the rest of BHA 1 can move along the borehole 100 freely.

Preferably, the BHA is a directional drilling assembly for drilling deviated boreholes.

In one arrangement, the BHA comprises a measurement while drilling (MWD) tool, preferably, installed near or adjacent to the drilling tool, and preferably installed into the housing. The MWD tool serves to read and measure drilling parameters. Alternatively or additionally, the BHA may comprise a logging while drilling (LWD) tool. Preferably, the MWD or LWD tool comprises a coupling which is designed to be interposed between the drill bit and another BHA component or between a BHA component and a pipe of the drill string and which includes at least one chamber containing the measurement equipment; and wherein the chamber opens into an axial channel of the coupling. Such a coupling is described in detail in US2011/0266057.

In an embodiment of the invention, the reaming tool is positioned in the BHA next to the MWD or LWD and spaced from the MWD or LWD in the axial backward direction. Preferably, in such an embodiment, the reaming tool is made from a non-magnetic material so as not to interfere with the MWD or LWD functions. Preferably, the reaming tool is mounted on a non-magnetic drill collar adjacent to the MWD or LWD. Where a pair of reaming tools is provided, preferably, a non-magnetic drill collar extends between the reaming tools.

In principle, the reaming tool can be made from a non-magnetic material, for example a non-magnetic steel or alloy, irrespective of its position within the BHA. In another variation, the reaming tool can be made from a magnetic material, if it is sufficiently spaced apart from the MWD or LWD so as not to cause interference. A combination of non-magnetic and magnetic reaming tools can be used depending on the position of the reaming tool in relation to other elements of the BHA as would be apparent to those skilled in the art.

In another embodiment, the reaming tool can be wired, where an electrical connection can be passed through its internal bore to connect two tools one before it and one after it.

The assembly 1 prevents sticking during drilling as well as during POOH and is advantageous whenever stuck drill pipe problems are anticipated or expected such as:

Mobile formations
Fractured and faulted formations
Reactive formations
Over-Pressured formations
Hole cleaning problems
Unconsolidated formations
Key seats
Ledges and micro doglegs
Swelling shale and salt formations
Heavy back reaming
Tight spots The assembly 1 also can be utilized to solve:

Completions deployment problems due to poor hole quality
BHA poor dynamic performance due to poor hole quality Further features and advantages of the assembly 1 of the invention include:

Balanced and optimized cutting and reaming structure

Optimized mud flow through helical mud ways stabilization of cutting structure to improve reaming performance and to lower vibration Reduced torque compared to existing fixed blade stabilizers Improved hole gauge and shape Reduces torque and drag lost in reaming highly irregular holes Improves hole shape by removing ledges and irregularities Opens key seats and micro doglegs Modifications and improvements are envisaged without departing from the scope of the present invention as defined in the appended claims.

According to a fourth aspect of the invention, a method of reaming a borehole is provided. Such a method comprises the steps of:

providing a downhole assembly such as disclosed hereinabove;

attaching the assembly to a forward end of a drill string;

drilling a pilot borehole until the downhole assembly reaches a target depth beneath surface; and withdrawing the drillstring from the borehole while rotating the reaming tool of the downhole assembly thereby reaming the borehole and eliminating borehole irregularities sufficiently to render the borehole ready for performing completion processes and preventing the BHA of the assembly from sticking while being withdrawn from the borehole.

What is claimed is:

1. A reaming tool comprising:

a body having a longitudinal axis and an upper end opposite a lower end; and a plurality of blades located on said body, each blade comprising:

a reaming surface having three or more reaming inserts arranged on at least a portion of the reaming surface in a number N of rows extending substantially parallel to a longitudinal axis of said reaming surface, wherein N is greater than two, the rows being laterally spaced from each other by a predetermined distance R, wherein the shortest distance along said longitudinal axis of said body between any two nearest inserts in two adjacent rows and between any two nearest inserts in two opposing outer rows is a predetermined value Y such that substantially equal load is applied on the reaming inserts in the longitudinal and circumferential directions; and a cutting surface having cutters disposed on at least a portion thereof, wherein radial distances between an outermost portion of all of said cutters and said longitudinal axis of said body are less than or equal to radial distances between an outermost portion of said reaming inserts and said longitudinal axis of said body.

2. The reaming tool of claim 1, wherein said reaming inserts comprise a truncated dome having a substantially flat top as an exposed contact area.

3. The reaming tool of claim 1, wherein said body comprises a number M of blades forming a reaming gauge portion and disposed on said body according to an M-fold rotational symmetry with respect to the longitudinal axis of said body.

4. The reaming tool of claim 1, wherein said blade is arranged to form a helix on the body.

5. The reaming tool of claim 1, wherein two adjacent inserts in the same row are spaced by a predetermined distance L and the shortest distance in the direction of the longitudinal axis of said body between two adjacent inserts in the same row can be determined as $X=L \cos \alpha$, and wherein the distance Y is X/N and $\alpha$ is the angle between the longitudinal axis of said body and the longitudinal axis of said reaming surface.

6. The reaming tool of claim 1, wherein each row nearest to a longitudinal edge of the reaming surface is offset from the longitudinal edge by a predetermined distance E, and wherein the ratio R/E is between 1.25 and 1.5.

7. The reaming tool of claim 1, wherein one or more of said cutters are configured so that an extended longitudinal axis of said cutter is positioned at an angle $\theta$ between 5 degrees and 35 degrees with respect to a plane perpendicular to the longitudinal axis of said body.

8. The reaming tool of claim 7, wherein said angle $\theta$ is between 15 degrees and 25 degrees.

9. A downhole assembly comprising a bottom hole assembly for drilling a borehole, the bottom hole assembly comprising:

a housing including a drilling tool disposed at a distal end; and a reaming tool comprising:

a body having a longitudinal axis and an upper end opposite a lower end; and a plurality of blades located on said body, each blade comprising:

a reaming surface having three or more reaming inserts arranged on at least a portion of the reaming surface in a number N of rows extending substantially parallel to a longitudinal axis of said reaming surface, wherein N is greater than two, the rows being laterally spaced from each other by a predetermined distance R, wherein the shortest distance along said longitudinal axis of said body between any two nearest inserts in two adjacent rows and between any two nearest inserts in two opposing outer rows is a predetermined value Y such that substantially equal load is applied on the reaming inserts in the longitudinal and circumferential directions; and a cutting surface having cutters disposed on at least a portion thereof, wherein radial distances between an outermost portion of all of said cutters and said longitudinal axis of said body are less than or equal to radial distances between an outermost portion of said reaming inserts and said longitudinal axis of said body.

10. The downhole assembly of claim 9, further comprising a measurement-while-drilling or logging-while-drilling tool located proximate to the reaming tool.

11. The downhole assembly of claim 10, wherein the reaming tool is made from a non-magnetic material.

12. The downhole assembly of claim 9, wherein the reaming tool comprises an electrical connection passing through an internal bore to connect one or more tools on either side in the bottom hole assembly.

13. The downhole assembly of claim 9, wherein said reaming inserts comprise a truncated dome having a substantially flat top as an exposed contact area.

14. The downhole assembly of claim 9, further comprising two or more reaming tools axially spaced in the bottom hole assembly.

15. The downhole assembly of claim 9, wherein one or more of said cutters are configured so that an extended longitudinal axis of said cutter is positioned at an angle $\theta$ between 5 degrees and 35 degrees with respect to a plane perpendicular to the longitudinal axis of said body.

16. A method of reaming a borehole comprising the steps of:

providing a downhole assembly attached to a drillstring, wherein the downhole assembly comprises:

a housing including a drilling tool disposed at a distal end; and a reaming tool comprising:

a body having a longitudinal axis and an upper end opposite a lower end; and a plurality of blades located on said body, each blade comprising:

a reaming surface having three or more reaming inserts arranged on at least a portion of the reaming surface in a number N of rows extending substantially parallel to a longitudinal axis of said reaming surface, wherein N is greater than two, the rows being laterally spaced from each other by a predetermined distance R, wherein the shortest distance along said longitudinal axis of said body between any two nearest inserts in two adjacent rows and between any two nearest inserts in two opposing outer rows is a predetermined value Y such that substantially equal load is applied on the reaming inserts in the longitudinal and circumferential directions; and a cutting surface having cutters disposed on at least a portion thereof, wherein radial distances between an outermost portion of all of said cutters and said longitudinal axis of said body are less than or equal to radial distances between an outermost portion of said reaming inserts and said longitudinal axis of said body;

drilling a pilot borehole until the downhole assembly reaches a target depth beneath the surface; and moving the drillstring within the borehole while rotating the reaming tool of the downhole assembly.

17. The method of claim 16, wherein one or more of said cutters of the reaming tool are configured so that an extended longitudinal axis of said cutter is positioned at an angle θ between 5 degrees and 35 degrees with respect to a plane perpendicular to the longitudinal axis of said body.

* * * * *